United States Patent [19]

Inumada

[11] Patent Number: 4,724,291

[45] Date of Patent: Feb. 9, 1988

[54] VARIABLE OUTPUT MICROWAVE OVEN

[75] Inventor: Masato Inumada, Aichi, Japan

[73] Assignee: Kabushiki Kaisha Toshiba, Kawasaki, Japan

[21] Appl. No.: 905,192

[22] Filed: Sep. 9, 1986

[30] Foreign Application Priority Data

Sep. 24, 1985 [JP] Japan ..... 60-210415

[51] Int. Cl.[4] ..... H05B 6/68

[52] U.S. Cl. ..... 219/10.55 B; 363/124

[58] Field of Search ..... 219/10.55 B; 363/124

[56] References Cited

U.S. PATENT DOCUMENTS 4,023,004 5/1977 Burke ..... 219/10.55 B
4,319,317 3/1982 Fukui et al. ..... 363/124
4,481,447 11/1984 Stupp et al. ..... 219/10.55 B

FOREIGN PATENT DOCUMENTS 55-33593 8/1980 Japan .

*Primary Examiner*—Philip H. Leung
*Assistant Examiner*—L. K. Fuller
*Attorney, Agent, or Firm*—Cushman, Darby & Cushman

[57] ABSTRACT

A microwave oven having a magnetron whose output level may be varied from 100% down to 0% of full magnetron power by a control section including an inverter circuit. The control section controls the output of the magnetron by varying the duration of first output pulses coupled to the inverter circuit in a first "regular" output range of the magnetron from 100% down to a predetermined % of full magnetron power and also controls magnetron output by intermittently supplying second output pulses to the inverter circuit in a second "low" output range from the predetermined power % down to substantially 0% of full power.

8 Claims, 5 Drawing Figures

VARIABLE OUTPUT MICROWAVE OVEN

BACKGROUND OF THE INVENTION

1. Field of the Invention

The present invention relates, in general, to microwave ovens. More specifically, the invention is directed to a microwave oven having a substantially continuously variable output power, even in a low power range.

2. Description of the Prior Art

Microwave ovens having a variable magnetron output power are known. They generally employ an inverter circuit which supplies the magnetron with an A.C. voltage obtained by inverting rectified commercial A.C. power. An inverter circuit can continuously vary its output by changing the ON-OFF period of a switching element thereof. Therefore, it would seem most suitable to use an inverter circuit to control the magnetron for different kinds of food or cooking.

However, there is a problem in using an inverter circuit as described above. It is difficult to control magnetron output in a "low" output power range. Typically, a power transistor switching element is controlled on and off by a high frequency. The collector current-waveform of the power transistor of the inverter circuit fluctuates as magnetron output approaches 0%. A breakdown of the power transistor may ultimately occur.

To avoid such breakdown the magnetron is arranged to provide, whenever it operates, at least a minimum power output, such as, for example, 200 watts. No power control below that minimum output is carried out. As a practical matter therefore, it is not always possible to obtain a suitable level of magnetron output power for a given cooking requirement.

SUMMARY OF THE INVENTION

The primary object of this invention is to provide a microwave oven having a substantially continuous output power control from 100% down to 0% of full magnetron power.

Another object of this invention is to provide an improved control device which can provide heating control suitable for different kinds of cooking or food even in a low power output range.

To achieve the above objects, the present invention provides a cooking apparatus including a heating device for heating food and a setting section for setting the heating device to either a first output state or a second output state whose output is lower than that of the first output state. A signal output section outputs either first output pulses which are generated when the heating device has been set at the first output state or second output pulses, corresponding to a minimum output within the first output state of the heating device, which are generated when the heating device has been set at the second output state. An inverter circuit controls a heating output of the heating device in response to the first or second output pulses from the signal output section.

The cooking apparatus further includes a first control section, including a first variable resistor to set a desired output level of the heating device within the range from 100% power down to a first predetermined % power which causes the output of the inverter circuit to be varied by controlling pulse duration of the first output pulses of the signal output section when the heating device has been set at the first output state. A second control section outputs control pulses which control a supply duration of the second output pulses to the inverter circuit when the heating device has been set at the second output state. This second control section includes an operational amplifier and a second variable resistor for setting a desired output level of the heating device within the range from the first predetermined % of power down to substantially 0% power by varying a pulse duration of the control pulses and a gate section causing the signal output section to intermittently feed the second output pulses to the inverter circuit in response to the control pulses fed from the second control section. Thus, it is made possible to continuously control output power from 100% down to substantially 0% of full magnetron power.

BRIEF DESCRIPTION OF THE DRAWINGS

The present invention may be more fully understood with reference to accompanying drawings, forming part of the invention disclosure, wherein:

FIG. 4(*b*) is a waveform diagram of an output of the control section shown in FIG. 1.

DETAILED DESCRIPTION OF THE PREFERRED EMBODIMENT

The presently preferred embodiment of the present invention will be now described in more detail with reference to the accompanying drawings. Although presently preferred, this embodiment is but one example of the embodiments that are possible based on the principles of the invention.

Figure 1:
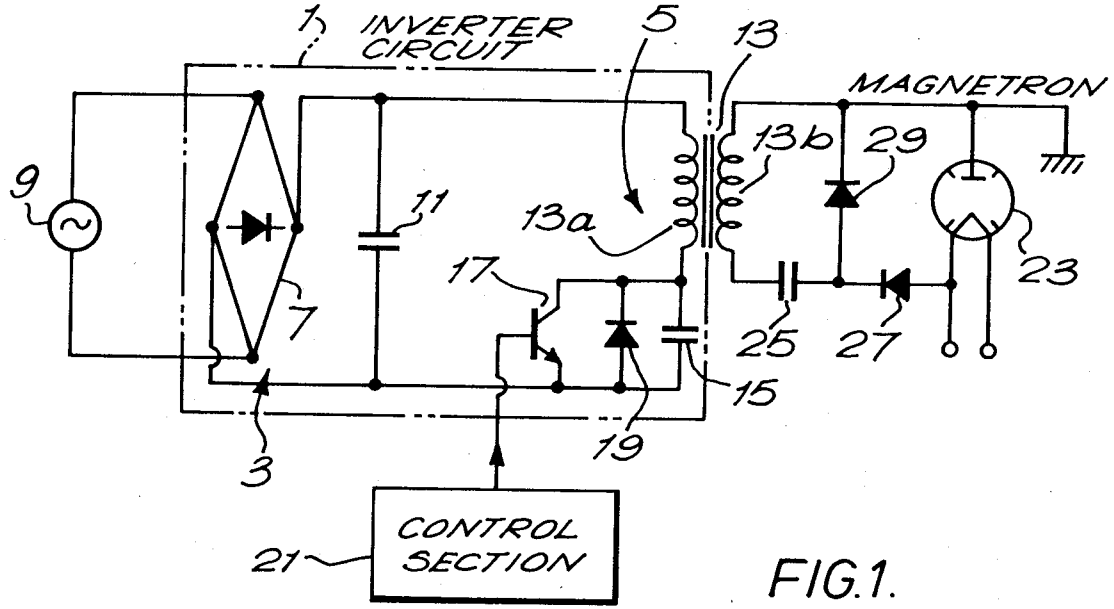
FIG. 1 a circuit diagram of a power output circuit according to an embodiment of the present invention.

FIG. 1 shows a power output circuit according to the present invention. An inverter circuit 1 includes a rectifier section 3 and an inverter section 5. Rectifier section 3 includes a diode-bridge 7 whose input terminals are connected to a commercial A.C. power supply 9 and a smoothing capacitor 11 which is connected to output terminals of diode-bridge 7. Inverter section 5 includes a high-voltage transformer 13, a capacitor 15 and an NPN power transistor 17. One of the terminals of a primary winding 13*a* of high-voltage transformer 13 is connected to one of the output terminals of diode-bridge 7, e.g. its plus side terminal. The other terminal of primary winding 13*a* is connected to the other terminal of diode-bridge 7, e.g. its minus side terminal, through capacitor 15. NPN transistor 17 is connected in parallel with capacitor 15. The cathode of a damper diode 19 is connected to the emitter of transistor 17. The base of transistor 17 is connected to a control section 21 which will be further described. The primary winding 13*a* of high-voltage transformer 13 and capacitor 15 form a series resonance circuit.

A D.C. output voltage from rectifier section 3 is inverted into an A.C. voltage of a prescribed frequency, e.g. 20 KHz, by operating transistor 17 on and off in response to pulse signals from control section 21. One of the terminals of a secondary winding 13*b* of high-voltage transformer 13 is connected to the cathode of a magnetron 23 which radiates microwave radiation to heat food. The other terminal of secondary winding 13b is connected to the cathode of magnetron 23 through a high-voltage capacitor 25 and a high-voltage diode 27 connected in series. The cathode of a high-voltage diode 29 is connected to one of the other terminals of secondary winding 13b of high-voltage transformer 13 and the anode thereof is connected to the other terminal of secondary winding 13b through capacitor 25. A half-wave voltage doubling rectifier circuit is formed by capacitor 25 and diodes 27 and 29. The anode of magnetron 23 is grounded, and a cathode heater is provided with a prescribed heating voltage.

Figure 2:
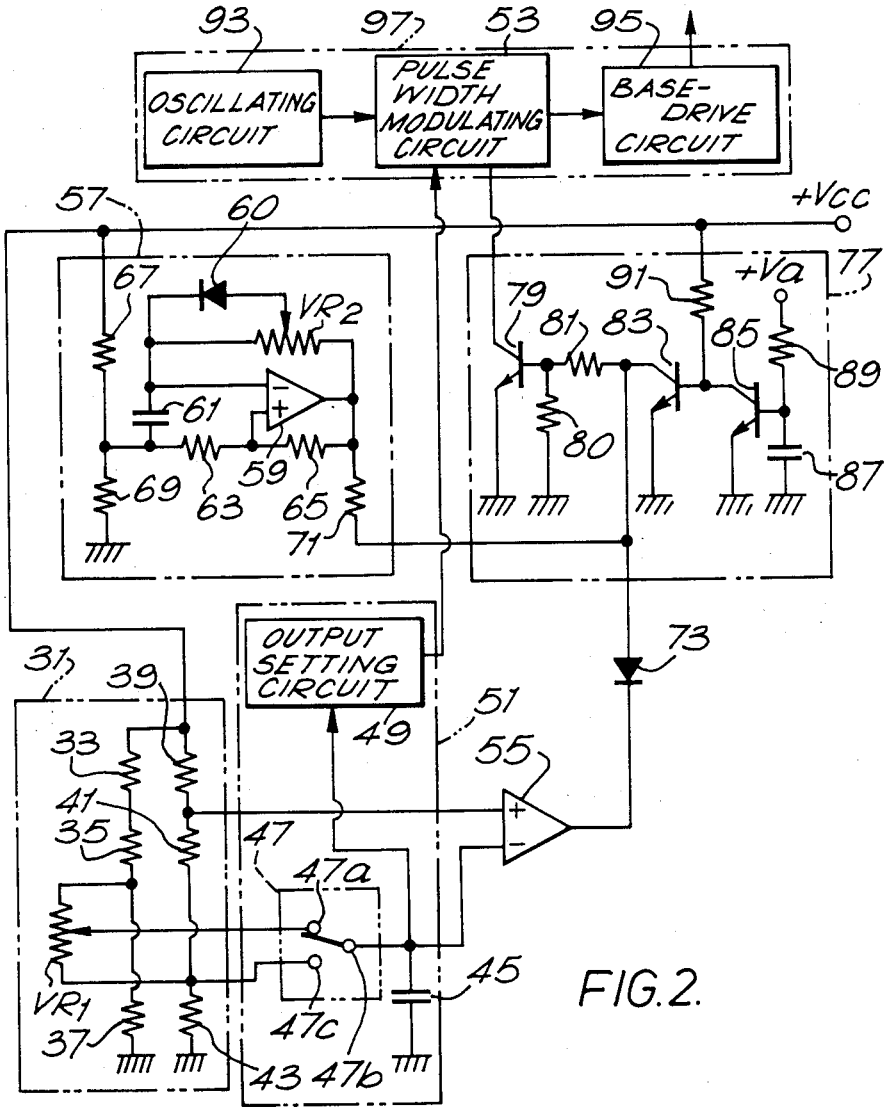
FIG. 2 is a circuit diagram of control section 21 shown as a block in FIG. 1.

FIG. 2 is a detailed circuit diagram of the essential portion of control section 21 shown as a block in FIG. 1. A first control section 31 includes an output controller (slide resistor) $VR_1$ which moves in response to rotation of an output control knob (not shown) and resistors 33, 35, 37, 39, 41 and 43 arranged to form a bridge circuit. Resistors 33, 35 and 37 are connected in series to one another. Resistors 39, 41 and 43 are also connected in series to one another. Output controller $VR_1$ is coupled from the connecting point of resistors 35 and 37 to the connecting point of resistors 41 and 43. A slide terminal of output controller $VR_1$ is connected to one of the terminals of a capacitor 45 through a first fixed terminal 47a and movable terminal 47b of changeover switch 47. Since changeover switch 47 is switched in response to a "pull-push" action of the output control knob, first fixed terminal 47a is closed when the knob is pushed and second fixed terminal 47c is closed when the knob is pulled.

Consequently, the voltage (slide terminal voltage) produced at the slide terminal of output controller $VR_1$ is supplied to capacitor 45 through terminals 47a and 47b of changeover switch 47. The voltage (low output setting voltage) produced at resistor 43 is supplied to capacitor 45 through terminals 47c and 47b. The voltage produced at capacitor 45 is fed to an output setting circuit 49.

A setting section 51 includes changeover switch 47, capacitor 45 and output setting circuit 49. Output setting circuit 49 feeds a pulse width modulating circuit 53 with an output setting signal which has a voltage level corresponding to the voltage fed from capacitor 45. The voltage produced at capacitor 45 is also coupled to an inverting input terminal (−) of a comparator 55. A non-inverting input terminal (+) of comparator 55 is connected to a connecting node between resistors 39 and 41 of first control section 31 and thus a reference voltage produced by the bridge circuit of first control section 31 is coupled to the non-inverting input terminal of comparator 55.

A second control section 57 includes an operational amplifier 59 and a low output controller (slide resistor) $VR_2$ which also moves in response to rotation of the output control knob described above. One end of low output controller $VR_2$ is connected to an inverting input terminal (−) of operational amplifier 59 and the other end thereof is connected to an output terminal of operational amplifier 59. A slide terminal of low output controller $VR_2$ is connected to the inverting input terminal of operational amplifier 59 through a diode 60. A series circuit of capacitor 61 and resistor 63 is coupled between inverting and non-inverting input terminals of operational amplifier 59. A resistor 65 is connected between the non-inverting input terminal and the output terminal of operational amplifier 59. A connecting node between resistors 67 and 69 is connected to a connecting node between capacitor 61 and resistor 63.

Figure 4A:
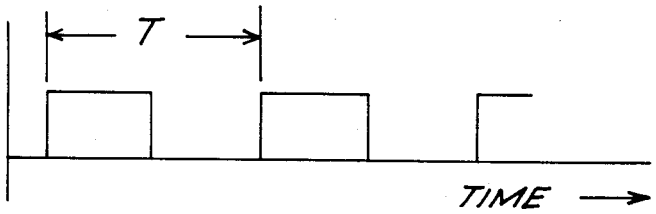
FIG. 4(*a*) is a waveform diagram of control pulses of the second control section shown in FIG. 2.

Operational amplifier 59 and low output controller $VR_2$ serve as a bistable multivibrator to output a pulse signal (control pulses), as shown in FIG. 4(a). The pulse width corresponds to the voltage produced at the slide terminal of low output controller $VR_2$. The output terminal of operational amplifier 59 is connected to the output terminal of comparator 55 through a resistor 71 and a diode 73. The output terminal of operational amplifier 59 of second control section 57 is further connected to the base of an NPN transistor 79 of a changeover circuit 77 (gate means) through resistors 71 and 81 and is also connected to the collector of an NPN transistor 83, the emitter of which is grounded. The base of transistor 79 is grounded through a resistor 80. The base of NPN transistor 83 is connected to the collector of NPN transistor 85, the emitter of which is grounded. The base of NPN transistor 85 is grounded through a capacitor 87 and is also connected to a resistor 89. The connecting point between the base of transistor 83 and collector of transistor 85 is connected to a D.C. voltage (+Vcc) terminal through a resistor 91. The collector of NPN transistor 79 is connected to pulse width modulating circuit 53 and the emitter thereof is grounded. The D.C. voltage (+Vcc) is fed to the base of NPN transistor 83 through resistor 91. The D.C. voltage is also supplied to the non-inverting input terminal of operational amplifier 59 of second control section 57 and to the connecting point between resistors 33 and 39 of first control section 31.

Pulse width modulating circuit 53 produces pulse signal first output pulses (or second output pulses) whose pulse width is determined by comparing an output setting signal fed from output setting circuit 49 with a sawtooth wave signal provided by an oscillating circuit 93. The pulse signal produced by pulse width modulating circuit 53 is coupled to a base drive circuit 95 during the OFF-state of transistor 79 of changeover circuit 77. Base drive circuit 95 controls transistor 17 as shown in FIG. 1 ON and OFF in response to the pulse signal from pulse width modulating circuit 53. A signal output section 97 includes oscillating circuit 93, pulse width modulating circuit 53 and base drive circuit 95.

When a cooking start button (not shown) is operated, D.C. voltage (+Vcc) is coupled to changeover circuit 77, second control section 57 and first control section 31. The slide terminal voltage, the low output setting voltage and the reference voltage are individually produced in the first control section. Operational amplifier 59 of second control section 57 outputs the control pulses. Furthermore, transistor 83 of changeover circuit 77 turns ON. When transistor 83 is ON, control pulses from second control section 57 are coupled to ground through the collector and emitter of transistor 83 so that transistor 79 is maintained OFF.

(1) Normal Output Range Of Magnetron.

When the output control knob (not shown) is pushed, first fixed terminal 47a is closed. A desired power output of magnetron 23 can be set by rotating the output control knob. Regular output controller $VR_1$ is slid together with low output volume controller $VR_2$ in response to the rotation of the output control knob. At this time, since first fixed terminal 47a of changeover switch 47 has been closed, the slide terminal voltage of regular output controller $VR_1$ corresponding to the desired output of magnetron 23 is supplied to capacitor 45 through changeover switch 47 so that capacitor 45 is charged by the supplied voltage.

The voltage charged in capacitor 45 is then coupled to output setting circuit 49. As described above, the output setting signal whose output level corresponds to the voltage of capacitor 45 is coupled from output setting circuit 49 to pulse width modulating circuit 53. Since transistor 79 has been OFF as described above, pulse width modulating circuit 53 outputs the pulse signal (first output pulses) whose pulse width is determined by comparing the level of the output setting signal fed from output setting circuit 49 with the level of the sawtooth wave signal supplied from oscillating circuit 93. Base drive circuit 95 controls transistor 7 of inverter circuit 1 on and off on the basis of the pulse signal (first output pulses) fed from pulse width modulating circuit 53. As transistor 17 turns on and the series resonance circuit composed of primary winding 13*a* of high-voltage transformer 13 and capacitor 45 is resonated so that an A.C. power having a prescribed voltage and frequency is produced at secondary winding 13*b* of high-voltage transformer 13. Since magnetron 23 radiates microwave energy into a heating chamber (not shown) by the A.C. power from high-voltage transformer 13, the food in the heating chamber is heated by dielectric heating action.

As the voltage of capacitor 45 gradually rises, the pulse width of the pulse signal outputted from pulse width modulating circuit 53 becomes wider. Therefore, also, the heating output of magnetron 23 gradually rises from the minimum level. Finally, the voltage of capacitor 45 becomes the same as that of slide terminal voltage set by output controller $VR_1$.

Figure 3:
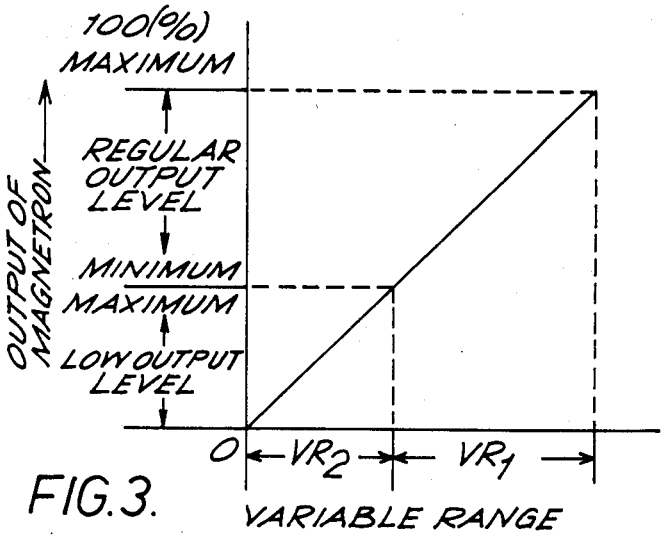
FIG. 3 is a graph illustrating the relationship between magnetron output and an output setting range of variable resistors $VR_1$ and $VR_2$.

As can be seen in FIG. 3, rotation of output controller $VR_1$ causes the output of magnetron 23 to vary continuously from the predetermined level, e.g. 200 (W) or approximately 30% of maximum magnetron output up to 100% of full power. Since capacitor 87 of changeover circuit 77 is charged with a D.C. voltage (+Va) produced when the cooking begins, transistor 85 turns ON. When transistor 85 turns ON, transistor 83 turns OFF so that the output pulse signal from second control section 57 is coupled to transistor 79 through resistor 81. However, since the voltage of capacitor 45 fed to the inverting input terminal of comparator 55 becomes higher than the reference voltage of the non-inverting input terminal, the output of comparator 55 goes to logical zero. The output signal from second control section 57 flows to ground through diode 73 and comparator 55. Therefore, transistor 79 is maintained OFF, and the magnetron maintains the heating output set by output controller $VR_1$.

(2) Low Output Range Of Magnetron.

When the output control knob is pulled, second fixed terminal 47*c* is closed. The low output setting voltage produced at resistor 43 is coupled to capacitor 45 through changeover switch 47 so that capacitor 47 is charged by the supplied voltage. An output setting signal (set signal) whose output level corresponds to the voltage of capacitor 45 is supplied from output setting circuit 49 to pulse width modulating circuit 53. Pulse width modulating circuit 53 generates the pulse signal (second output pulses) whose pulse width is determined by comparing the level of the output setting signal fed from output setting circuit 49 with the level of the sawtooth wave signal supplied from oscillating circuit 93. Base drive circuit 95 thus controls transistor 17 on and off on the basis of the pulse signal fed from pulse width modulating circuit 53.

Since the voltage level from capacitor 45 is low, the pulse width of pulse signals fed from pulse width modulating circuit 53 is narrow. Therefore, the pulse duration of transistor 17 which is operated on and off through base drive circuit 95 is small so that the heating output of magnetron 23 is maintained at the minimum output level of magnetron 23 in the regular output state (at the maximum output level of magnetron 23 in the low output state as shown in FIG. 3). Since the voltage of capacitor 45 is lower than the reference voltage, the output of comparator 55 goes to logical one. The output pulse signal from second control section 57 is supplied to transistor 79 and thus transistor 79 is controlled on and off while transistor 83 is off.

Figure 4:
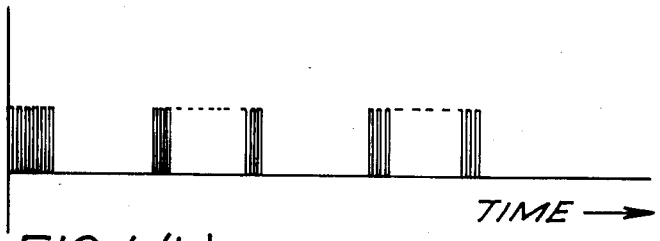

In response to the ON-OFF operation of transistor 79, pulse width modulating circuit 53 is operated ON and OFF. As shown in FIG. 4(*b*), pulse width modulating circuit 53 intermittently outputs the pulse signal (second output pulses) on the basis of the ON-OFF operation of transistor 79. Since transistor 17 of inverter circuit 1 is controlled on and off with the above-described pulse signal from pulse width modulating circuit 53 while transistor 79 is off, the heating output of magnetron 23 is repeatedly changed between the maximum output of low output state and zero output. In this case, since the pulse width of the output pulse signal from second control section 57 is determined by the slide terminal voltage of low output volume controller $VR_2$, the output duration of the maximum output, e.g. 200 (W), in the low output state of magnetron 23 (low power range) can be changed by the operation of low output controller $VR_2$.

Since the heating output of magnetron 23 can be continuously varied from 100% to 0% of full magnetron power by output controller $VR_1$ and low output controller $VR_2$, cooking operations such as e.g. "THAWING" "STEW" or "KEEP WARM" which need lower heating output can be effectively carried out. Since the ON-OFF operation of inverter circuit 1 is carried out in the low output state as described above, no surge current occurs thereby preventing damage to electronics components normally caused by the surge current. Furthermore, since the output control and low output control can be executed by operating only one output control knob and the switching from the regular output control to the low output control and vice versa can be carried out by only pulling or pushing the output control knob, the cooking apparatus can be conveniently used.

The minimum output in the regular output state (the maximum output in the low output state) may be determined on the basis of the circuit arrangement, although the minimum output in the regular output state is selected to be 200 (W) or 30% of the maximum output of magnetron 23. Furthermore, a slide type output control knob may be used in place of the rotation type output control knob.

In summary, the present invention overcomes the disadvantages of the prior art and provides an improved cooking apparatus which may continuously vary the heating output of the magnetron from 100% to substantially 0% of full magnetron power.

Many changes and modifications in the above-described embodiment can be carried out without departing from the scope of the present invention. Therefore, the appended claims should be construed to include all such modifications.

What is claimed is:

1. A variable power cooking apparatus comprising:

means for heating food;

setting means for establishing either a first output state wherein said heating means has output levels equal to or above a predetermined minimum output level or a second output state wherein said heating means has output levels below said predetermined minimum output level, said output levels in said second state varying between said predetermined minimum output level and approximately zero;

signal output means for outputting first output pulses or second output pulses, said frist output pulses being generated when said first output state has been established and said second output pulses having a pulse duration corresponding to said predetermined minimum output level within said first output state when said second output state has been established;

inverter means for controlling a heating output of said heating means in response to said first or second output pulses from said signal output means;

first control means for causing said output of said inverter means to be varied by controlling a pulse duration of said first output pulses of said signal output means in response to the existence of said first output state;

second control means for outputting control pulses which control a supply duration of said second output pulses fed from said signal output means to said inverter means in response to the existence of said second output state; and gate means for causing said signal output means to intermittently feed said second output pulses to said inverter means in response to said control pulses from said second control means.

2. A cooking apparatus according to claim 1, wherein said first control means includes a first variable resistor to set a desired output level of said heating means.

3. The cooking apparatus according to claim 2, wherein said setting means includes output setting means for feeding an output setting signal corresponding to said desired output level to said signal output means when said heating means has been set at said first output state.

4. The cooking apparatus according to claim 3, wherein said signal output means includes an oscillating circuit and a pulse width modulating circuit to output said first output pulses based on said output setting signal fed from said setting means.

5. The cooking apparatus according to claim 1, wherein said setting means includes voltage producing means for producing a voltage corresponding to said minimum output level within said first output state of said heating means.

6. A cooking apparatus according to claim 5, wherein said setting means includes output setting means for feeding said signal output means with a set signal corresponding to said voltage of said voltage producing means when said heating means is changed from said first output state to said second output state, said signal output means generating said second output pulses on the basis of said set signal.

7. A cooking apparatus according to claim 6, wherein said second control means includes a bistable multivibrator including an operational amplifier and a second variable resistor to output said control pulses, said second variable resistor varying a pulse duration of said control pulses to set a desired output level of said heating means.

8. A cooking apparatus including an inverter circuit and a magnetron whose output is controlled by the inverter circuit, said cooking apparatus comprising:

means for setting said magnetron to either a first output state wherein said magnetron output is equal to or above a predetermined minimum output level or a second output state wherein said magnetron output is below said predetermined minimum output level, said magnetron output in said second state varying between said predetermined minimum output level and approximately zero;

means for controlling said output of said magnetron by varying a pulse duration of a first output pulse fed to said inverter circuit when said magnetron has been set at said first output state and for controlling said output of said magnetron by intermittently supplying a second output pulse to said inverter circuit when said magnetron has been set at said second output state.

* * * * *